US010357119B2

(12) United States Patent
Kalm et al.

(10) Patent No.: US 10,357,119 B2
(45) Date of Patent: Jul. 23, 2019

(54) DISPLAY UNITS FOR PRODUCT TESTERS

(71) Applicant: The Royal Promotion Group, Inc., New York, NY (US)

(72) Inventors: Brett R. Kalm, Stratford, CT (US); Karla Lopez, Brooklyn, NY (US)

(73) Assignee: The Royal Promotion Group, Inc., New York, NY (US)

( * ) Notice: Subject to any disclaimer, the term of this patent is extended or adjusted under 35 U.S.C. 154(b) by 0 days.

(21) Appl. No.: 15/828,108

(22) Filed: Nov. 30, 2017

(65) Prior Publication Data

US 2019/0159609 A1 May 30, 2019

(51) Int. Cl.

| | |
|---|---|
| ***A47F 7/28*** | (2006.01) |
| ***A47F 5/10*** | (2006.01) |
| ***A47F 7/00*** | (2006.01) |
| ***A47F 1/12*** | (2006.01) |
| ***A47F 5/00*** | (2006.01) |

(52) U.S. Cl.

CPC ..... *A47F 7/286* (2013.01); *A47F 1/125* (2013.01); *A47F 5/0025* (2013.01); *A47F 5/105* (2013.01); *A47F 7/0021* (2013.01)

(58) Field of Classification Search

CPC ..... A47F 7/286; A47F 5/105; A47F 7/0021; A47F 7/0028; A47F 1/125; A47F 5/0025

USPC ..... 211/60.1, 65, 69–69.4, 72, 73, 132.1; 206/581, 526, 764, 765, 756; D28/73, 86

See application file for complete search history.

(56) References Cited

U.S. PATENT DOCUMENTS 563,787 A * 7/1896 Moyer ..... B43L 25/10 211/69.4
740,927 A * 10/1903 Roberts ..... A47F 5/112 211/73
935,419 A * 9/1909 Smith ..... A61C 19/02 206/369
1,054,487 A * 2/1913 Bagley ..... B65D 5/5206 206/762
1,412,846 A * 4/1922 Dietsche, Jr. ..... A47F 3/145 211/73
1,455,524 A * 5/1923 Fargo ..... A47B 65/00 211/42
1,539,641 A * 5/1925 Brunhoff ..... A47F 3/14 211/49.1
1,546,983 A * 7/1925 House ..... B65D 73/0085 211/73

(Continued)

FOREIGN PATENT DOCUMENTS

| | | |
|---|---|---|
| WO | 1998/024348 | 6/1998 |
| WO | 2015/081265 A1 | 6/2015 |
| WO | 2016/200975 A1 | 12/2016 |

OTHER PUBLICATIONS

International Search Report and Written Opinion of the International Searching Authority, International Searching Authority, PCT /US2018/063219, dated Jan. 28, 2019.

*Primary Examiner* — Jonathan Liu

*Assistant Examiner* — Devin K Barnett

(74) *Attorney, Agent, or Firm* — Dorf & Nelson LLP; Scott D. Locke, Esq.

(57) ABSTRACT

A product display tester unit is provided to allow for the efficient and effective display of goods, such as creams, lotions, and serums. The display tester unit comprises a fluted panel, a ledge and a base. The display tester unit may be used as part of a display system, and its components are reversibly associated within one another.

15 Claims, 5 Drawing Sheets

(56) References Cited

U.S. PATENT DOCUMENTS 1,568,941 A * 1/1926 Gibson ..... A47B 87/0223 211/126.7
1,576,283 A * 3/1926 Johnson ..... A47F 5/10 211/126.16
1,609,945 A * 12/1926 Hermani ..... A47F 3/14 211/135
1,717,456 A * 6/1929 Lasher, Jr. ..... A47F 5/112 211/73
1,731,411 A * 10/1929 Franklin ..... A47F 5/10 211/132.1
1,752,017 A * 3/1930 Metzger ..... A47F 5/112 211/73
1,973,188 A 9/1934 Verderber
2,012,551 A * 8/1935 Steen ..... A47B 23/043 211/73
2,035,021 A * 3/1936 Pyle ..... A47F 5/112 211/73
2,081,070 A * 5/1937 Schoettle ..... B65D 5/5206 206/45.22
2,109,586 A * 3/1938 Einbinder ..... A47F 11/04 211/134
2,165,255 A * 7/1939 Hamilton ..... A47B 23/043 248/455
2,224,530 A * 12/1940 Weinstein ..... A47B 23/043 211/43
2,474,036 A * 6/1949 Curley ..... H01F 7/0247 211/69.9
D155,024 S * 8/1949 Mozneck ..... 211/69
2,490,356 A * 12/1949 Hummel ..... A47B 23/043 211/72
2,560,161 A * 7/1951 Fay ..... A47F 5/005 211/128.1
D165,565 S * 12/1951 White ..... D28/73
2,726,835 A * 12/1955 Hummel ..... A47F 5/112 211/73
3,088,585 A * 5/1963 Solenghi ..... A45D 40/00 206/457
3,184,073 A * 5/1965 Bartolucci ..... A47F 5/112 211/132.1
3,410,516 A * 11/1968 Criswell ..... A47B 23/04 248/459
3,494,479 A * 2/1970 Martin ..... A47F 5/112 211/126.16
3,501,018 A * 3/1970 Solo ..... B44B 1/00 211/131.1
D217,633 S * 5/1970 Iorio ..... D32/55
D222,520 S * 10/1971 Caine ..... 132/318
3,634,937 A * 1/1972 Green ..... A61C 19/02 433/77
3,751,172 A * 8/1973 Seitz ..... B01L 9/06 211/73
3,939,987 A * 2/1976 Bustos ..... A47F 5/112 211/134
3,995,925 A 12/1976 Roesler
4,106,614 A 8/1978 Aylott
D260,455 S * 9/1981 Haswell ..... D6/630
D267,379 S 12/1982 Winter
4,397,395 A * 8/1983 McKelvey ..... B25H 3/003 206/369
4,401,222 A 8/1983 Kulikowski et al.
4,412,618 A * 11/1983 La Conte ..... B25H 3/06 132/286
4,611,720 A 9/1986 Staab
D290,534 S * 6/1987 Wendkos ..... D28/76
4,681,234 A * 7/1987 Wisnieswski ..... B25H 3/003 206/377
D295,796 S * 5/1988 Wadsworth ..... D28/73
4,858,863 A * 8/1989 Lin ..... A47G 21/103 248/174
4,967,915 A * 11/1990 Robson ..... A47B 81/068 211/184
5,031,647 A 7/1991 Seidler
D328,314 S * 7/1992 MacEwan ..... D19/90
D332,468 S * 1/1993 Tarozzi ..... D19/106
5,192,386 A * 3/1993 Moir ..... A45D 40/0087 156/249
D338,195 S * 8/1993 Sugerman ..... D14/461
5,312,000 A 5/1994 Bass
5,368,161 A * 11/1994 Plais ..... A61C 19/02 206/369
D362,565 S * 9/1995 Tubbs ..... D6/310
D368,187 S * 3/1996 Johnson ..... D6/682
D374,582 S * 10/1996 Chu ..... D6/407
5,570,793 A 11/1996 Killough
D392,498 S * 3/1998 Steinbeck ..... D6/629
5,810,182 A * 9/1998 Levin ..... A47F 5/112 211/195
D404,220 S * 1/1999 Stravitz ..... D6/407
5,868,367 A * 2/1999 Smith ..... A47F 5/112 211/73
5,881,910 A 3/1999 Rein
5,884,889 A * 3/1999 Crosby ..... A47B 23/04 248/444
5,934,487 A * 8/1999 Hoeg ..... A47B 63/00 211/13.1
D414,166 S * 9/1999 De Paris ..... D14/447
5,961,927 A * 10/1999 Isaacs ..... B01L 9/54 211/60.1
5,971,168 A * 10/1999 Proulx ..... A47G 19/30 211/73
6,082,553 A * 7/2000 Stravitz ..... A47B 63/00 206/308.1
6,129,219 A 10/2000 Piekert
6,164,461 A * 12/2000 Ward ..... G11B 33/0461 211/40
6,390,307 B1 * 5/2002 Stelter ..... A63B 61/02 211/60.1
D530,117 S * 10/2006 Nomoto ..... D6/675.3
7,905,362 B2 3/2011 Slimane
8,186,522 B2 5/2012 Weshler et al.
8,282,065 B1 * 10/2012 Stone ..... A47B 23/044 16/221
D673,391 S * 1/2013 Whitehead ..... D6/682.4
D674,392 S * 1/2013 Cheng ..... D14/434
D681,625 S * 5/2013 Zehner ..... D14/253
D681,626 S * 5/2013 Zehner ..... D14/253
D687,245 S * 8/2013 Salagnac ..... D6/526
D690,308 S * 9/2013 McCoy ..... D14/458
8,679,065 B2 * 3/2014 Schuman ..... G09F 3/0295 211/60.1
D702,998 S * 4/2014 Fugere ..... D7/409
8,701,900 B2 * 4/2014 Childers ..... G10G 5/00 181/199
8,763,819 B2 7/2014 Theisen et al.
8,807,501 B2 * 8/2014 Chung ..... B25H 3/04 211/70.8
9,211,001 B2 * 12/2015 Negretti ..... A47B 23/04
9,380,853 B2 7/2016 Ports et al.
D781,841 S * 3/2017 Salathe ..... D14/253
D791,699 S * 7/2017 Watanabe ..... D13/108
D797,669 S * 9/2017 Chang ..... D13/108
9,907,727 B2 * 3/2018 Sharpe ..... A61J 1/16
2005/0150848 A1 * 7/2005 Hun ..... B25H 3/003 211/69
2006/0060547 A1 * 3/2006 Chang ..... A47F 1/12 211/73
2008/0230672 A1 * 9/2008 Pachowski ..... A47B 23/044 248/453
2011/0011814 A1 * 1/2011 Moss ..... A47F 5/112 211/73
2012/0080393 A1 * 4/2012 Eisman ..... A47B 43/00 211/86.01
2012/0329011 A1 12/2012 Clark
2013/0213911 A1 8/2013 Theisen et al.
2014/0230295 A1 * 8/2014 Hawkins ..... A47F 5/0025 40/606.03
2015/0144581 A1 5/2015 Ports et al.
2015/0230630 A1 * 8/2015 Taylor ..... A47F 5/10 29/426.2

(56) References Cited

U.S. PATENT DOCUMENTS

| | | | | |
|---|---|---|---|---|
| 2016/0120308 | A1* | 5/2016 | Kubiniec | A47B 81/005<br>211/64 |
| 2016/0338487 | A1* | 11/2016 | McGrane | A47B 23/04 |
| 2017/0071333 | A1* | 3/2017 | Fox, III | A47B 23/042 |
| 2018/0153281 | A1* | 6/2018 | Contag | A45D 44/005 |

* cited by examiner

DISPLAY UNITS FOR PRODUCT TESTERS

FIELD OF THE INVENTION

The present invention relates to the field of consumer product display units.

BACKGROUND OF THE INVENTION

Consumers of beauty care and personal care products, including but not limited to make-up, creams, and lotions, often prefer to try these items before purchasing them. For the manufacturers of these cosmetics, enticing a consumer to try a particular product can be a challenge on at least three fronts. First, there is an issue of informing a consumer that a particular product exists. Second, there is an issue of how to make a product standout among competing products. Third, there is an issue of how cost-effectively to grant access to the product for sampling.

One tactic for marketing products is to display them in an aesthetically pleasing environment within a store. In order to do this while maximizing the use of available floor space and shelf space, manufacturers and store owners often rely on display units. These display units may provide products on shelves for easy access for the consumers. Sometimes the display units will also provide access to an item for trial by the consumer. Typically these items, which may be referred to as "testers," are placed in front of additional units of the same item that the consumer may purchase.

When granting consumers access to testers, manufacturers and store owners face at least two challenges. First, when making testers available, vendors need to have an adequate means for encouraging the return of a tester to the same location from which the consumer picked up the item, while maintaining the overall intended aesthetic design of the display. Second, vendors need to find, but to date, have not found, an adequate means for flexibly accommodating different sized products on the same unit at the same and or different times. Thus, there is a need for new and flexible display units that provide access to testers, as well as for systems that incorporate these display units and methods for using these display units.

SUMMARY OF THE INVENTION

The present invention provides display tester units, systems that incorporate display tester units, and methods for displaying items within these units or systems. Through the various embodiments of the present invention, one can efficiently and effectively assemble and use a versatile display tester unit for giving customers access to items such as creams, lotions, haircare products, serums, and make-up.

According to a first embodiment, the present invention is directed to a product, e.g., cosmetic, display tester unit comprising: (a) a base, wherein the base comprises: (i) a front surface, (ii) a bottom, and (iii) a receiving region, wherein the receiving region is located on a side of the base opposite from the bottom and the receiving region comprises a first surface and a second surface, wherein each of the first surface and the second surface has a highest edge and a lowest edge, wherein the first surface slopes downward toward the second surface, and wherein the highest edge of the first surface is higher than the lowest edge of the second surface and the highest edge of the second surface is higher than the lowest edge of the first surface; (b) a ledge, wherein the ledge has a first inner surface and a second inner surface, wherein the first inner surface of the ledge is smaller than the first surface of the receiving region; and (c) a fluted panel, wherein the fluted panel comprises a plurality of alternating peaks and valleys.

According to a second embodiment the present invention comprises a product, e.g., cosmetic, display system comprising: (I) a product display tester unit, wherein the product display tester unit comprises (a) a base, wherein the base comprises: (i) a front surface, (ii) a bottom, and (iii) a receiving region, wherein the receiving region is located on a side of the base opposite from the bottom and the receiving region comprises a first surface and a second surface, wherein each of the first surface and the second surface has a highest edge and a lowest edge, wherein the first surface slopes downward toward the second surface, and wherein the highest edge of the first surface is higher than the lowest edge of the second surface and the highest edge of the second surface is higher than the lowest edge of the first surface; (b) a ledge, wherein the ledge has a first inner surface and a second inner surface, wherein the first inner surface of the ledge is smaller than the first surface of the receiving region; and (c) a fluted panel, wherein the fluted panel comprises a plurality of alternating peaks and valleys; (II) a merchandising tray; and (III) a plurality of adjustable rails, wherein the adjustable rails are capable of defining a plurality widths of one or more columns within the merchandising tray, wherein the cosmetic display unit and the merchandising tray are located on a shelf. When the tray is in use, the columns may be oriented perpendicular to the length of the display tester unit so that products for sale may be presented behind testers of those products.

According to a third embodiment the present invention comprises a product, e.g., cosmetic, display system comprising: (a) a shelf for displaying items; (b) a merchandising tray; and (c) a plurality of adjustable rails, wherein the adjustable rails are capable of defining a plurality widths of one or more columns within the merchandising tray, and wherein a display tester unit and the merchandising tray are located on a shelf. In some of these embodiments, there is a rail and pusher system for moving products forward on a shelf or within a merchandising tray. Further, in some embodiments, there is a plurality of merchandising trays, wherein each tray is positioned behind a display tester unit of the present invention. Additionally, there may be a plurality of shelves, wherein each shelf may independently have one or more merchandising trays and one or more display tester units.

According to a fourth embodiment, the present invention provides a method for displaying one or a plurality of items such as one or more beauty care or personal care products on a display tester unit. The method comprises: (a) placing a ledge of the present invention on a base of the present invention; (b) placing a fluted panel of the present invention on the base; (c) placing an item on the fluted panel, wherein at least two edges of the item contact the fluted panel at opposite sides of a cavity of the fluted panel, and wherein the item has a diameter or width that is less than the distance between the pair of consecutive peaks that define the cavity into which it is inserted. Step (c) may be repeated in different cavities of the fluted panel with the same or different sized items and the same or different types of goods.

DETAILED DESCRIPTION OF THE INVENTION

Reference will now be made in detail to various embodiments of the present invention, examples of which are illustrated in the accompanying figures. In the following detailed description, numerous specific details are set forth in order to provide a thorough understanding of the present invention. However, unless otherwise indicated or implicit from context, the details are intended to be examples and should not be deemed to limit the scope of the invention in any way.

Furthermore, headings are provided for the convenience of the reader and are not intended to be and should not be construed as limiting any of the embodiments described herein.

Display Tester Unit

Figure 1A:
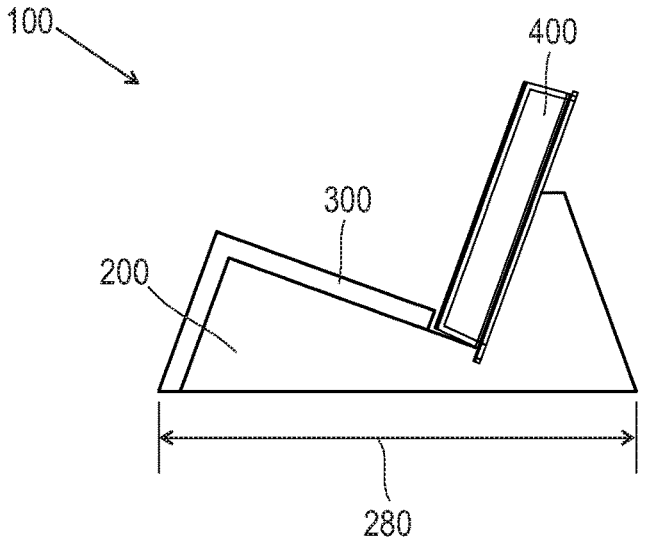
FIG. 1A is a representation of the side view of a display tester unit of the present invention as assembled.
Figure 1B:
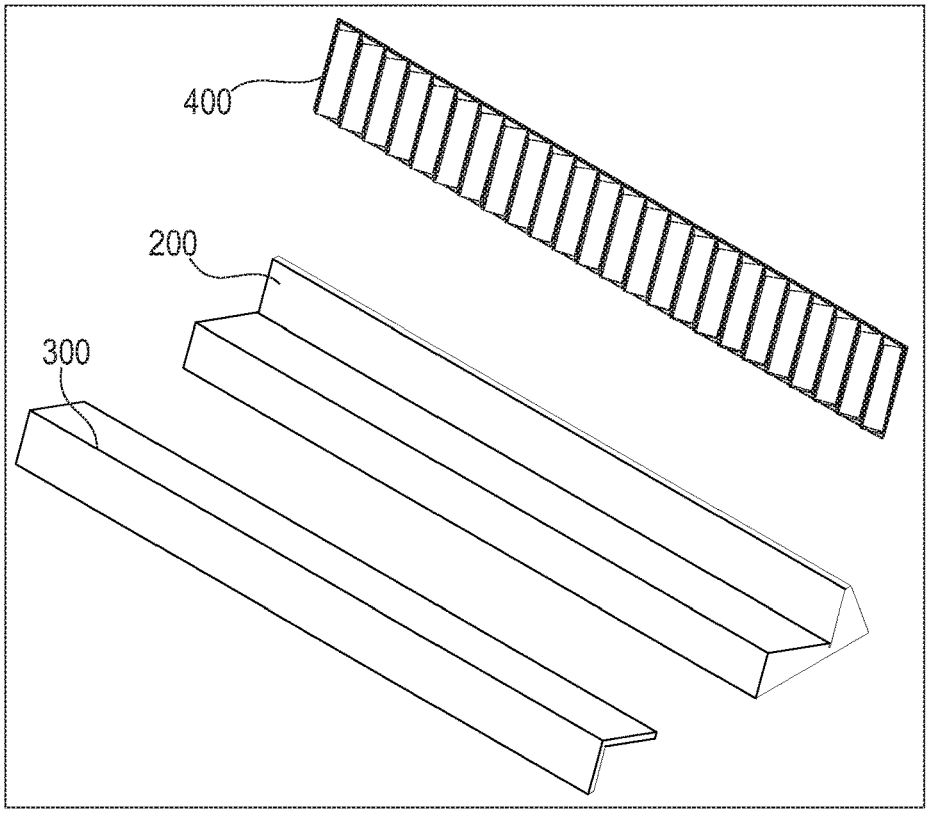
FIG. 1B is a representation of the individual component parts of the display tester unit of FIG. 1A.

According to a first embodiment, the present invention is directed to a display tester unit 100, an example of which is shown as assembled in FIG. 1A and as separate components in FIG. 1B. The display tester unit comprises, consists essentially of, or consists of a base 200, a ledge 300, and a fluted panel 400. In some embodiments each of these elements is capable of being reversibly associated or coupled with one more or other elements of the display tester unit, being held in place exclusively, or in part, by gravity. Thus, the components may be reversibly associated and disassociated from other elements without destroying the integrity of any of the other elements and with each element being reusable.

Although in some embodiments, the elements of the display tester unit are associated as part of the unit exclusively by gravity, i.e., have an absence of other structures and forces that facilitate association, in other embodiments one or more additional means for association are present. For example, elements may be designed with one or more reciprocal or mating snaps, or loop and hook fasteners, or magnets and metal elements to retain association. Additionally or alternatively, one or more elements may be constructed of or have a coating that has a sufficiently high coefficient of static friction that facilitates the elements being associated with each other or one another. These enhanced friction surfaces, if present, may be on the sides that are noted below as coming into contact with each another.

Base

Figure 2A:
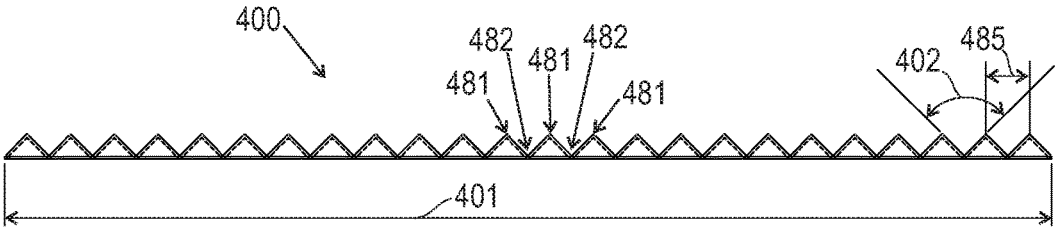
FIG. 2A is a representation of a fluted panel of the present invention.
Figure 2B:
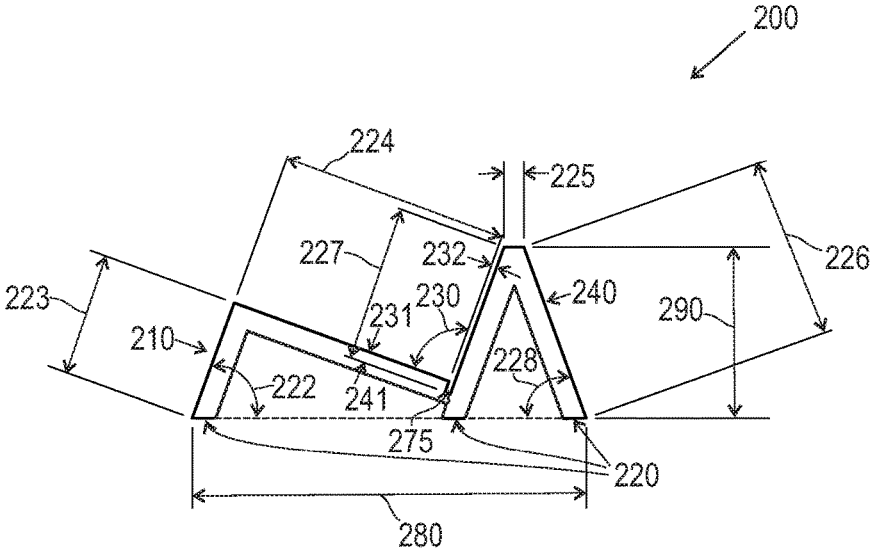
FIG. 2B is a representation of a base of the present invention.

One of the components of the present invention is the base, an example of which is shown in FIG. 2B. The base is configured to provide a foundation element on which the ledge and fluted panel can rest. The base may comprise, consist essentially of, or consist of one or more of plastic, silicone, rubber, metal, a metal oxide or wood or a combination thereof. Optionally, the base has a finish, e.g., a custom color lacquer. Preferably, the base is rigid and does not compress under the weight of the ledge, the fluted panel, or the products that are displayed. Similarly, preferably each of the ledge and the fluted panel are also rigid. Further, in some embodiments, the base may be configured such that the fluted panel and ledge are capable of resting on it without touching the surface, e.g., a shelf, on which the base rests.

The display may be solid or it may be partially or completely hollow and thus be in part or in whole, a skeleton frame. Further, when the base is not solid, any one or more sides may independently be solid or contain one or more gaps.

The base 200 may be defined by or comprise: (i) a front surface 210, (ii) a bottom 220, and (iii) a receiving region 230. The base also comprises a rear surface 240.

The front surface 210 may be solid or contain one or more openings. In some embodiments, the front surface is angled relative to the bottom, which establishes or defines a plane, e.g., a horizontal plane. Thus, in some embodiments, the front surface may form an angle of, for example, 20 degrees to 90 degrees relative to the bottom or an angle of 30 degrees to 80 degrees relative to the bottom or an angle of 40 degrees to 75 degrees relative to the bottom or an angle of 50 degrees to 75 degrees relative to the bottom. When the front surface is not perpendicular to the bottom of the base, it may extend upward and toward the rear of the base. In some embodiments, the front surface is smooth, and optionally, planar.

As noted above, the bottom 220 may be solid or it may be open, e.g., the bottom may be comprised of one or more elements that are configured to permit the base to rest stably on another surface, e.g., a flat surface. Thus, it may be defined by a plurality of legs, e.g., 2 to 10 legs or 4 to 8 legs. In some embodiments, preferably the bottom of the base defines a plane and when resting on a shelf the plane is horizontal. Thus, as an alternative to legs, the base may be a solid side or a side with one or more gaps. All other elements of the base may be defined relative to the plane that the bottom of the base defines. In addition to defining a plane, the bottom defines a real or imaginary footprint 280 of the base. For ease of description, when the base is contiguous, flat, and has no gaps, the footprint is the surface area of the bottom, an example, of which appears in FIG. 1A. When the bottom is not contiguous and, for example, the plane of the bottom is defined by legs 220 as shown in FIG. 2B, then the footprint 280 (shown in dotted lines) refers to the area of the space defined by those legs were there a continuous flat surface formed between them. When referring to the length (side to side) or width (front to back) of the base, unless otherwise indicated, one is referring to the greatest distance of the length and width of the base, including any gaps.

In some embodiments, the footprint of the bottom is rectangular. In other embodiments, it is an irregular or other regular shape, for example, an ellipse, a circle, or an oval, etc. In still other embodiments, the bottom is defined by a plurality of legs (e.g., 2 to 20 legs, or 4 to 10 legs or 6 to 8 legs) or bars that span a portion of the length or width of the bottom, e.g., two bars that are parallel or four bars that define the frame or perimeter of a rectangle.

When the base is solid it also may contain left and right side surfaces. Alternatively, the base may be open on one or both of the left and right sides, which are the sides that span from the front surface to the rear surface.

The base also comprises a receiving region 230. The receiving region is located on a side of the base opposite from the bottom, and it is between the front surface and the rear surface. The receiving region comprises a first surface 231 and a second surface 232. The receiving region may be configured to form two sides of a cavity for receiving portions or all of the other elements of the display unit. In some embodiments, the cavity defined by the receiving region is open on the ends that meet the side walls of the base. Thus, in these embodiments, no side walls of the base extend vertically beyond the first surface and the second surface. In other embodiments, side walls of the base extend upward beyond one or both of the first surface and the second surface. When side walls do extend vertically, they may, for example, uniformly or not uniformly extend from $1/16^{th}$ of an inch to 1 inch higher than either or both of the first surface and the second surface. The receiving region may also be referred to as a cradle or cavity forming region, with two or more sides.

Each of the first surface and the second surface has a highest edge and a lowest edge. The highest edge of each surface is farther away from the plane defined by the bottom of the base than that surface's respective lowest edge. Additionally, the highest edge of the first surface is higher than the lowest edge of the second surface and the highest edge of the second surface is higher than the lowest edge of the first surface. Further, the first surface slopes downward toward the second surface, and the second surface slopes downward toward the first surface and toward the front of the unit.

In some embodiments, the first surface and the second surface may come together at an edge to form an angle or rounded concave region. Each of the first surface and the second surface may independently be flat, curved or contoured. In some embodiments, the cross section of the base that forms the receiving region forms an "L" or a "V" or a modified "L" or "V." In some embodiments, the plane of the first surface and the plane of the second surface form an angle of approximately 70 degrees to 120 degrees or 80 degrees to 100 degrees or would form such an angle were they to intersect.

The angle formed by the front surface and the first surface at the edge at which they intersect or the edge at which the planes in which they lay would intersect, may, for example, form an angle of 20 degrees to 90 degrees, 30 degrees to 80 degrees, 40 degrees to 75 degrees, or 50 degrees to 75 degrees. As noted above, the front surface may also be defined relative to the base and in some embodiments, that angle 222 is 30 to 90 degrees or 33 to 85 degrees or 40 to 80 degrees or 50 to 75 degrees.

The width 223 of the front surface, which is the distance from the lowest edge of the front surface to its highest edge, may for example, be ½ inch to 18 inches or ¾ inches to 12 inches or 1 inch to 6 inches. The width 224 of the first surface, which is the distance from the highest edge of the first surface to its lowest edge, may for example, be ½ inch to 24 inches or ¾ inch to 18 inches or 1 inch to 12 inches or 2 to 6 inches. In some embodiments, the width of the first surface is larger than the width of the front surface, e.g., at least 25% larger or at least 50% larger.

The width 227 of the second surface, which is the distance from the highest edge of the second surface to its lower edge, may, for example, be ½ inch to 24 inches or ¾ inch to 12 inches or 1 inch to 12 inches or 2 inches to 6 inches. In some embodiments, the width of the first surface is larger than the width of the second surface, e.g., at least 25% larger or at least 50% larger. In other embodiments, the width of the second surface is larger than the width of the first surface, e.g., at least 25% larger or at least 50% larger.

In some embodiments, the first surface has a surface area that is at least 10%, at least 20%, at least 30%, at least 40% or at least 50% greater than the surface area of the second surface. In other embodiments, the second surface has a surface area that is at least 10%, at least 20%, at least 30%, at least 40% or at least 50% greater than the surface area of the first surface. In some embodiments, the highest edge of the second surface, which is a distance away from the closest point on the plane defined by the bottom, is at least 10%, at least 20%, at least 30%, at least 40% or at least 50% greater than the distance between the highest edge of the first surface and the closest point on the plane defined by the bottom to it.

In some embodiments, the highest edge of the second surface, which is the highest height of the base 290 is ¾ of an inch to 24 inches or 2 inches to 12 inches or 3 inches to 8 inches away from the bottom of the base. In some embodiments, the highest edge of the first surface is ½ to 6 inches or 1 to 5 inches or 2 inches to 4 inches away from the bottom of the base.

In some embodiments, each of the front surface, the first surface and the second surface are flat. Additionally, in some embodiments, each of the front surface, the first surface, and the second surface are smooth. Further, as shown in the figures, in some embodiments, there is no additional surface between the front surface and the first surface and there is no gap between them. In other embodiments, there may be one or more intervening surfaces and or a gap between the front surface and the first surface.

The first surface slopes downward toward the rear of the base and terminates at the first surface's lowest edge. In some embodiments, the first surface is rectangular and its lower edge is a straight line; in other embodiments the lower edge is another regular shape or is an irregular shape. Further, in some embodiments, the first surface is a uniform width.

As noted above, the receiving region also comprises a second surface. The second surface slopes upward toward the rear of the base. In some embodiments, the highest edge of the second surface is higher than the highest edge of the first surface, i.e., the highest edge of the second surface is farther away from the bottom of the base than the highest edge of the first surface is.

As shown in the figures, neither the first surface nor the second surface extends to the bottom of the base. Were the plane of each of the first surface and the second surface to extend to the bottom of the base, in some embodiments, each independently would form an angle of, for example, 20 degrees to 89 degrees, 30 degrees to 80 degrees, 40 degrees to 75 degrees, or 50 degrees to 75 degrees.

The rear surface 240 of the base may be perpendicular to the bottom of the base or it may slope downward toward the bottom of the base, at for example, an angle 228 of 20 degrees to 89 degrees, 30 degrees to 80 degrees, 40 degrees to 75 degrees, or 50 degrees to 75 degrees relative to the plane defined by the bottom of the base. In some embodiments, were the planes of the rear surface and the second surface extended to intersect with each other and the plane of the bottom of the base, they would define the sides of a prism that has a cross-section that is an equilateral triangle, an isosceles triangle, or a scalene triangle.

The width 226 of the rear surface, i.e., the distance from the base to the highest edge of the rear surface along the plane of the rear surface, if flat, may, for example, be ½ inch to 28 inches or ¾ inches to 1 inches or 1 inch to 12 inches or 2 inches to 6 inches. Because the second surface of the base does not extend to the base, when the highest edges of the rear surface and the second surface of the receiving region are the same height from the base 290, even if at the same angle, the width of the rear surface may be larger than the width of the receiving region. Additionally, the rear surface and the second surface of the receiving region may share a common upper edge or there may be a surface between them that is flat or regularly or irregularly contoured. If there is such a region, it may, for example, have a width 225 of $1/64^{th}$ of an inch to 2 inches of $1/16^{th}$ of an inch to 1 inch or of $1/8^{th}$ of an inch to ½ of an inch.

In some embodiments one or each of the second surface and the rear surface defines a plane, i.e., is flat, and they intersect at the highest edge of each of them. Thus, there is no intervening surface. In other embodiments, there is an intervening surface between them that is a regular (e.g., rectangular) or irregular shape and is flat or contoured, e.g., convex or concave or otherwise rounded.

In some embodiments, the first surface and the second surface meet at the bottom of the receiving region. In other embodiments, there is a space between the lowest edge of the first surface of the base and the second surface of the base. The space may be an opening of a recess 275, wherein the lowest edge of the second surface is located within the recess. When a space is present, it may, for example, be between $1/64^{th}$ of an inch and 2 inches wide or between $1/16^{th}$ of an inch and 1 inch wide or between $1/8^{th}$ of an inch and ¾ of an inch wide. The recess may for example, be between $1/8^{th}$ of an inch and 3 inches deep or between ½ an inch and 2 inches deep.

The recess may extend the complete length or partially along the length of the base (from the left side to the right side). In some embodiments, one or more than one side or each side of the recess is partially or completely flat or curved. The bottom of the recess may be flat of rounded and a regular or an irregular shape. One side of the recess is formed in part or entirely by the lower region of the second surface. The depth of the recess is shown in FIG. 2B by figure reference line identified as 241. When referring to width of the second surface, if the base has a recess, then the second surface's lowest edge is within the recess and is lower than the lowest edge of the first surface.

The sizes of the surfaces of the base are not limited by present invention. By way of non-limiting examples, each surface of the base may independently have a length (side to side) of from 3 inches to 6 feet or from 6 inches to 4 feet or from 12 inches to 2 feet. In some embodiments, one, a plurality or all surfaces of the base have the same and a uniform length. In some embodiments, the bottom of the base has a width (front to back) of from 1 inch to 10 inches or from 2 inches to 8 inches or from 3 inches to 6 inches.

Ledge

Figure 2C:
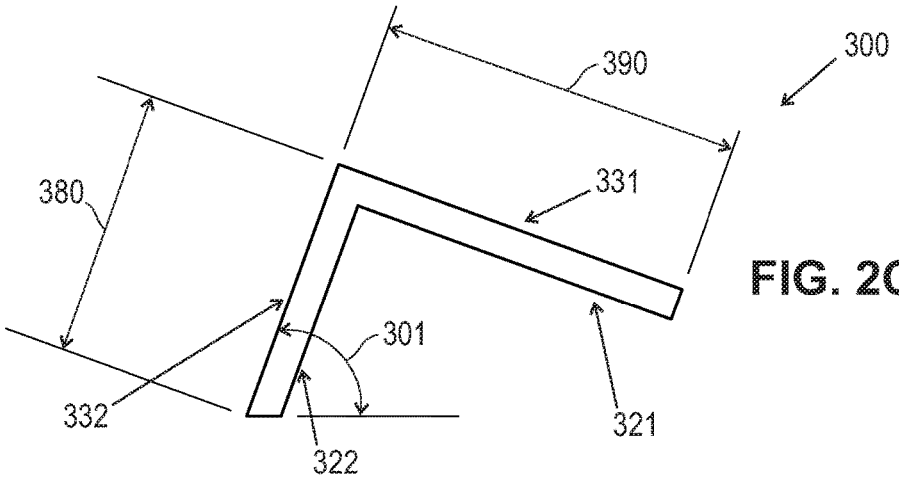
FIG. 2C is a representation of a ledge of the present invention.

The ledge 300 is shown in FIG. 2C and is designed to cover part or the entire front surface of the base and part of the first surface of the base. By way of a non-limiting the example the ledge may be in the form of or substantially in the form of an "L" or a derivative of an L that is for example rounded at the vertex. However, the contouring of the inner surface of the ledge may be designed or configured based on the contouring of the portion of the base that it will cover and thus, if the base has one or more surfaces between its front surface and its first surface, the ledge has reciprocal surfaces that permit stable nesting or resting with minimal or no space between the ledge and the base. The inner surfaces of the ledge as shown are a first inner surface 321 and a second inner surface 322.

The first inner surface of the ledge is configured to cover part or the entire first surface of the receiving region. Thus, in some embodiments, the first inner surface of the ledge is smaller than the first surface of the receiving region. By way of non-limiting examples, when the surface area of the first inner surface is smaller than the first surface of the base, the first inner surface is between 30% and 99% or between 50% and 95% or between 60% and 90% or between 70% and 85% of the size of the surface area of the first surface of the base beneath the front surface and the first surface.

The ledge may be shorter than (from side to side), the same size as or longer than the base. When the ledge is longer than the base, it may or may not contain side walls that cover part or all of the sides of the base.

When the ledge rests on the base and the first inner surface of the ledge is smaller than first surface of the base, the portion of the first surface of the base that the ledge does not cover is the portion that is proximate to the lowest edge of the first surface of the base. In some embodiments, the first inner surface is a rectangle or substantially a rectangle and the first surface of the base is also a rectangle or substantially a rectangle. In these embodiments, the portion of the first surface of the base that is not covered by the ledge may be rectangular or substantially a rectangle.

The second inner surface of the ledge is configured to cover part or the entire front surface of base. Thus, the second inner surface may be smaller than, the same size as or larger than the front surface. If it is larger than the front surface of the base, preferably, the display is positioned near the edge of a shelf and the second surface extends over the shelf.

The ledge also has a first outer surface 331 that is on the opposite side of the ledge from the first inner surface. Similarly, the ledge also has a second outer surface 332 that is on the opposite side of the ledge from the second inner surface. The width 390 of the first outer surface from the edge in common with the second outer surface to the distal end may, for example, be ½ inch to 18 inches or ¾ inches to 1 inches or 1 inch to 6 inches. The width 380 of the second outer surface from the edge in common with the first outer surface to the distal end may, for example, be ½ inch to 18 inches or ¾ inches to 1 inches or 1 inch to 6 inches. Additionally, there is an exterior surface between the first outer surface and the first inner surface and an exterior surface between the second outer surface and the second inner surface, each of which may be flat or contoured, and perpendicular or tapered relative to the surfaces that they contact. When in use, the angle 301 of the second surface to the plane of the shelf on which the base rests may be the same as that of the angle between the front surface of the base and the plane defined by the bottom of the base.

The ledge may have a uniform or non-uniform thickness. This thickness may, for example, be between $1/64^{th}$ of an inch and 2 inches or between $1/16^{th}$ of an inch and 1 inch or between $1/8^{th}$ of an inch and ¾ of an inch.

The ledge may comprise, consists essentially or consist of metal, a metal oxide, plastic, silicone, rubber, wood or a combination thereof. Additionally, one, a plurality or all sides of the ledge may be coated with a custom color lacquer. In some embodiments, the second outer surface is configured to allow product information or one or more labels to be adhered to it or written on it or printed on it. For example, it may be coated with a material on which erasable markers can write and from which they can be erased, or it may comprise a magnet to which labels with metal can be affixed.

In some embodiments, one, a plurality or each of the first inner surface, the second inner surface, the first outer surface and the second outer surface is flat and smooth. In some embodiments, one, a plurality or each of the first inner surface, the second inner surface, the first outer surface and the second outer surface is textured. In some embodiments, one, a plurality or each of the first inner surface, the second inner surface, the first outer surface and the second outer surface is contoured. If either or both of the first inner surface and the second inner surface of the ledge are contoured, preferably the contouring is consisting with or reciprocal to that of the first surface and front surface of the base, respectively. For example, if the first inner surface of the ledge has a concave portion, preferably the first surface of the base has a convex region located where the concave portion of the ledge rests. Similarly, if the second inner surface of the ledge has a convex portion, preferably the front surface of the base has a concave region located where the convex portion of the ledge rests.

Because the ledge may be held in place solely by gravity, it offers flexibility, and as products to be displayed change and or the fluted panel changes, one can change or retain the ledge. Additionally, one can retain a ledge and change one or more labels on the second outer surface of the ledge. This imparts flexibility and an economic advantage to the manufacturer of the display unit, the marketer of the products, and the owner of the store in which the products are to be displayed.

Fluted Panel

The fluted panel 400 of FIG. 2A is configured to comprise a plurality of alternating peaks 481 and valleys 482. In some embodiments, the cross-section of the alternating peaks and valleys form a regular (e.g., sinusoidal) or an irregular undulating wave or alternately, a "V" or "U" shape. In some embodiments, the distance 485 between each pair of consecutive peaks is independently between $\frac{1}{8}^{th}$ of an inch and 3 inches or between $\frac{3}{8}^{th}$ of an inch and 1½ inches.

There is no limit to the number of alternating peaks and valleys in a fluted panel, and for example, there may be at least two alternating peaks and valleys, at least three alternating peaks and valleys, at least five alternating peaks and valleys, at least ten alternating peaks and valleys, or at least twenty alternating peaks and valleys. In some embodiments that are 2-1000 or 10 to 500 or 50-250 or 10 to 40 alternating peaks and valleys within a fluted panel. A person of ordinary skill in the art will recognize that a set of two alternating peaks and valleys contains a first peak, a first valley, a second peak, and a second valley, with each additional peak and valley being capable of being identified by an ordinal number. The right and left sides may each be a peak, each be a valley, one be a peak and one be a valley, or each or one start between a peak and a valley, e.g., the midway portion.

In some embodiments, the fluted panel is solid. In other embodiments, a portion of or the entire fluted panel is hollow and/or the rear side has one or more gaps. In some embodiments the rear side comprises, consists essentially of, or consists of or is defined by a frame and except for the frame, which is along the perimeter of the panel there is an open space behind the rear side of the fluted panel. Depending on the construction of the fluted panel, when in use the second surface of the base may come into contact with a solid or partially solid backing that is not the underside of the valleys, or with the underside of the valleys, or with only a frame or with both a frame and the underside (also referred to as the outside) of the valleys. As discussed more fully below, the frame may be configured to comprise or function as an engagement element that is capable is sitting in a recess between the first surface and the second surface of the base.

Within any fluted panel, the space between each pair of consecutive peaks forms or defines a cavity. The cavity may be in part or in its entirety concave. In some embodiments, all cavities within the fluted panel are the same size and shape. Thus, they have the same depth, shape, contouring, and texturing of side walls, and are there is a uniform distance between the consecutive cavities. For example, in some embodiments, the tops of all of the peaks and the bottoms of all of the valleys each define planes that are parallel, and thus a uniform distance apart. Thus, the peaks have a uniform height relative to the plane defined by the bottom of the valleys. As persons of ordinary skill in the art will recognize, this fluting that forms the peaks and valleys will have a thickness and an inner surface that when the fluting is in use is distal to the base on which the fluted panel rests. In some embodiments, the fluting has a uniform thickness, while in other embodiments the fluting's thickness is variable. For example, in one embodiment, the fluting has a uniform thickness while the outer surface (that which will not come into contact with the products to be displayed) of the valleys contacts the second surface of the base, and the plane that they define is located on the plane that the second surface forms.

In other embodiments two or more cavities differ by one or more of the following parameters: depth, shape, contouring, texturing and distance to adjacent valleys. A non-limiting example of the surface of the cavities is that they are flat or flat except for a small amount of rounding at the bottom of the valleys and or at the top of the peaks. In another non-limiting example, the surface of the cavities is scalloped.

The walls of each cavity may, for example, be smooth or textured or a combination thereof, and optionally have or do not have a coating or treatment to increase friction. Additionally, the walls of each cavity may for example, be regularly or irregularly curved or flat or a combination thereof.

In some embodiments, the lowest points of the valleys may be rounded or they may be formed from the coming together of flat sides, e.g., with a cross-section of a "U" or "V" or derivation thereof. Similarly, but independently, the highest lowest parts of the peaks may be rounded or they may be formed from the coming together of flat sides as a three dimensional inverted "V" or "U" or derivation thereof. Between each consecutive pair of peaks there may be an angle 402 formed by a pair of rays that connect the vertex at the deepest point of a valley and the highest point of the peaks that for that cavity of that vertex (each the same distance from the edge of the fluted panel). This angle may, for example, be between 30 degrees and 150 degrees or between 50 degrees and 120 degrees or between 70 and 100 degrees.

By way of a non-limiting example, within the plurality of alternating peaks and valleys, a first pair of consecutive peaks is separated by a first distance and a second pair of consecutive peaks is separated by a second distance, wherein the first distance and the second distance are different. Thus, there may be different sized cavities within the fluting. If the fluted panel is comprised of a plurality of different sized peaks and valleys, or otherwise defines different sized cavities even if there is a uniform height of the peaks, a vendor may choose to put different sized products in the corresponding different sized peaks and valleys. However, one may put the same sized products in different sized valleys or different sized products in the same sized valleys. As a person of ordinary skill in the art would recognize, how deep within a valley a product sits will in part be a reflection of the width of the valley, the slope of the valley, and the depth of the valley. Further, any product that is larger than the distance between two peaks could sit on a display unit, but it would do so above the cavities, i.e., rest on two or more peaks.

The fluted panel may be defined by a front or inner side, which is the side that will contact the products on display, a rear or outer side, which is the side opposite the front side and the side that in part or in its entirety may contact the second surface of the base's receiving region, a first long side a second long side, a first short side and a second short side. Further the long sides may be opposite of each other and the short sides may be opposite of each other.

The length 401 as shown in FIG. 2A of the fluted panel may be as long as, shorter than or longer than the base, and independently as long as, shorter than or longer than the ledge. By way of non-limiting examples, the fluted panel may have a length (measured from the first short side to the second short side) of from 3 inches to 6 feet or from 6 inches to 4 feet or from 12 inches to 2 feet. In some embodiments, the fluted panel has width (first long side to second long side) of from 1 inch to 10 inches or from 2 inches to 8 inches or from 3 inches to 6 inches. Further, in some embodiments, the fluted panel has a length and a width, wherein the width is greater than the distance from the lowest edge of the second surface of the base to the highest edge of the second surface of the base. The fluted panel may or may not be symmetrical along its longitudinal axis (the axis parallel to the long sides). Additionally or alternatively, the fluted panel may or may not be symmetrical along its width axis (the axis parallel to the short sides).

When in use, the rear side of the fluted panel and/or a portion of it and/or its frame if present, contacts and rests on the second surface of the base. In some embodiments, a portion of the fluted panel will rest on or project over a portion of the first surface of the receiving region that the ledge does not cover. Thus, in one embodiment, the ledge contacts the front surface of the base, the first surface of the receiving region, and the fluted panel, and the fluted panel contacts the second surface of the receiving region. In some embodiments, the ledge may contact a plurality of peaks. In other embodiments, the ledge may contact the side edges of the fluting. In still other embodiments, the ledge does not contact the fluted panel and the surface of the ledge that is closest to the fluted panel is $1/64^{th}$ of an inch to 1 inch away from the fluted panel.

A portion of the fluted panel may be present that protrudes into the cavity defined by the recess between the first surface and the second surface. This protrusion, also known as an engagement element or recess engagement elements, does not contain undulations and is of a size and shape that allows it to be situated in the recess. In some embodiments, the recess engagement element is held in the recess partially or exclusively by gravity, and both it and the recess are smooth.

This protrusion may be on one side of the fluted panel, on two opposite side of the fluted panel and render the fluted panel, including the protrusion symmetrical along its long axis. Optionally, the fluted panel may also or alternatively be symmetrical along a vertical axis. Finally, in some embodiments, the protrusion is present along the entire perimeter of the fluted panel.

When the bottom of the valleys form a plane, the protrusion may be in the same plane that is formed by the plane formed by the inner surface of the valleys, or the outer surface of the valleys, or in a plane that is parallel to those planes but is farther away from the plane formed by the inner (exposed) surface of the peaks than from the outer surface of the valleys. When the valleys do not form a plane, the protrusion may be in a plane that contains the inner surface of the lowest valley, or the outer surface of the lowest valleys (relative to the highest peak), or in a plane that is lower than the inner surface or outer surface of the lowest valley. The recess engagement element may be as wide as or narrower than the space of the base into which it slides. Thus, for example, the protrusion may be between $1/64^{th}$ of an inch and 2 inches wide or between $1/16^{th}$ of an inch and 1 inch wide or between $1/8^{th}$ of an inch and ¾ of an inch wide. In some embodiments, the length of the protrusion (the dimension that extends toward the bottom of the recess), is shorter then, longer than or the same size and the depth of the recess. This it may for example, be between $1/8^{th}$ of an inch and 3 inches deep or between ½ an inch and 2 inches deep. Thus, the recess engaging element is configured to sit within the recess.

The fluted panel may, for example, be opaque, transparent, translucent, tinted, colored, or not permeable to light. In some embodiments, the fluted panel, including its protrusions and frame of the fluted regions, comprises, consists essentially of or consists of clear PETG and has a vacuum form and die cut flush finish. In other non-limiting examples, it comprises, consists essentially of or consists of plastic, silicone, rubber, metal, metal oxides, wood or a combination thereof.

Product Placement

The display tester unit, when assembled is configured to display one or a plurality of goods. The goods may be the same or different and they may be the same or different sizes and shapes. When the goods are different, they be related, for example, all cosmetics or unrelated. When the goods are cosmetics, they may, for example, include, but are not limited to make-up, such as lipstick, nail polish, mascara, blush, rouge, and foundation, lotions, creams, gels, and sera. The goods may also be haircare products, for example, shampoo, conditioner, hair gel, hair spray, hair mousse, and hair color. Further, the products may be sunscreens and or sun tan lotions.

When a plurality of goods is located on a display unit, those goods may be regularly or irregularly spaced. Additionally, the goods may be held in place partly or exclusively by gravity. Therefore, they are easily removed and put back on the display units in the same or different places. When the fluted panel is on an angle relative to the plane defined by the bottom of the base, the products that rest on the fluted panel will be oriented in the same angle.

As noted above, within any fluted panel, there may be uniform or non-uniform spacing and sizing of peaks and valleys. If there is uniform spacing and products of different sizes are placed on the same display tester unit, then those products may sit different distances forward. If, however, it is known that products of different sizes are to be placed on a display tester unit, then a manufacturer can construct the fluted panel with a plurality of cavities of different widths (i.e., different amounts of space between the peaks), with the widths being selected to accommodate the desired products. For example, a given fluted panel may contain 2-50 or 3-40 or 5-30 or 10-20 different sized cavities. The different sized cavities may be grouped together, spaced apart regularly or have irregular spacing. Additionally, there may be the same or different numbers of each of the cavities or different sizes. For example, when there are four different sized cavities, there may be one cavity of a first size, two cavities of a second size, three cavities of a third size, and four cavities of a fourth size.

In one embodiment, the unit may, for example, comprise a first cosmetic, wherein the first cosmetic has first cosmetic width and a second cosmetic, wherein the second cosmetic has second cosmetic width, wherein the first cosmetic width is different from the second cosmetic width, and the first cosmetic width is smaller than the distance between a first pair of adjacent peaks and the second cosmetic width is smaller than a second distance between a second pair of adjacent peaks. Each of the peaks within the first pair of adjacent peaks and within the second pair of adjacent peaks may be different or one of the peaks within each pair may be the same.

In another embodiment, the unit may, for example, comprise a first cosmetic, wherein the first cosmetic has first cosmetic width, a second cosmetic, wherein the second cosmetic has a second cosmetic width, and a third cosmetic, wherein the third cosmetic has a third cosmetic width, wherein the first cosmetic width is different from the second cosmetic width, and the first cosmetic width is smaller than a first distance between a first pair of adjacent peaks, the second cosmetic width is smaller than a second distance between a second pair of adjacent peaks, and the third cosmetic width is smaller than a third distance between a third pair of adjacent peaks. Each of the peaks within the first pair of adjacent peaks, within the second pair of adjacent peaks and within the third pair of adjacent peaks may be different or one of the peaks within any one pair may be the same as one peak in another pair.

In some embodiments, one, a plurality or each of the products has a diameter or largest width that is between 20 percent and 80 percent or between 30 percent and 70 percent or between 40 percent and 60 percent of the distance between the adjacent peaks between which the product sits. In some embodiments, one, a plurality or each of the products has a thickness from front to back that is between 20 percent and 200 percent or between 30 percent and 150 percent or between 70 percent and 120 percent of the height of the peaks between which the product sits relative to the valley (or the higher of the two peaks if those peaks are not the same height). Thus, in some embodiments, two sides or surfaces of the product intersect or abut each side of the valley at a point (for example if the product is a ball) or along an edge such that the product abuts the cavity along two tangents (for example, if the product is a brick or has a cylindrical shape).

Cosmetic Display System

Figure 3:
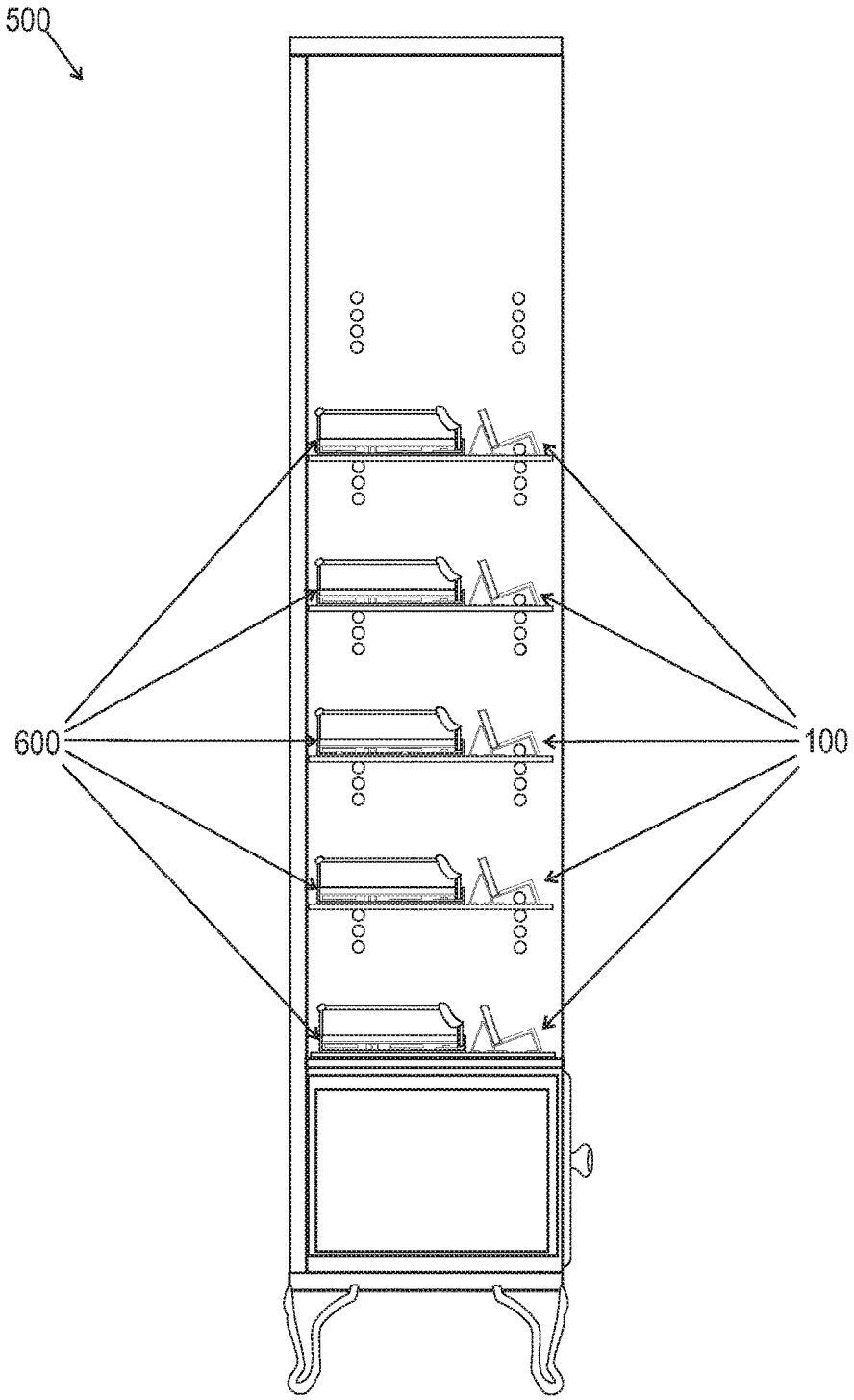
FIG. 3 is a representation of a system of the present invention.

The display tester unit of the various embodiments of the present invention may be used by itself, or a plurality, e.g., 2-50 or 3-40 or 4-30 or 5-15 may be used together as part of a cosmetic display system 500 as shown in FIG. 3. When a plurality of the display tester units 100 in FIG. 3 are used as part of the same system, the display tester units may be located on the same shelf next to each other or separated by a space. Additionally or alternatively, they may be located at different horizontal levels as shown in FIG. 3, each in front of a merchandising tray 600. Further, they may be located on a stationary shelf or as part of a display system that moves, e.g., rotates.

Figure 5:
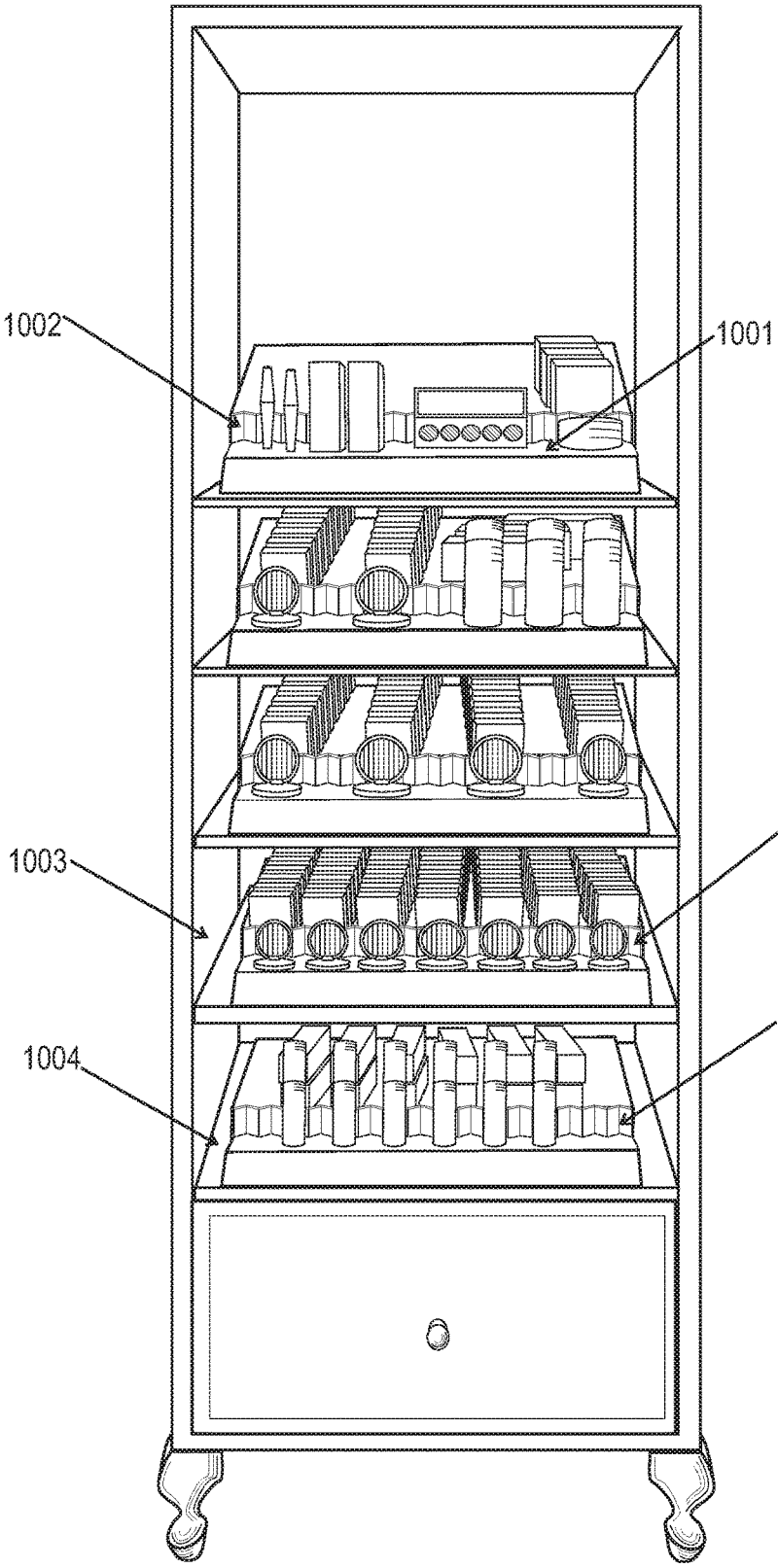
FIG. 5 is a representation of a system of the present invention with a plurality of products on a plurality of shelves that each contains a display tester unit of the present invention.

As shown in FIG. 5, which is a non-limiting example, on one shelf 1004, a display unit 1006 houses one type of product On a second shelf 1003 another display unit 1005 houses a single type of product that is different from the product on the first shelf. The first display unit and the second display may have fluted panels with different sized cavities, but as shown, within each fluted panel there is uniformity of size of the cavities. On a third shelf, a display unit 1001 may house a plurality of different products that are different from what is housed on other shelves and that rest at different points in the fluting 1002. To accommodate the different products, there may be a plurality of different sized cavities in the same fluted panel.

Each display unit may be located in front of a merchandising tray. A merchandising tray may, for example, be a flat surface, an angled surface, or a surface with tiers, or a combination thereof and side walls that is configured to house products. These products may, for example, be ones that are capable of being displayed on the display tester unit, i.e., one or more of the products each has a diameter that is smaller than the distance between a pair of consecutive peaks.

Each display unit may have a tray that is open or it may contain dividers that allow for the segregation of items. The dividers may be fixed or moveable. For example, in some embodiments, the system of the present invention comprises one or more merchandising trays and for one or more of those merchandising trays, a plurality of adjustable rails. These adjustable rails are capable of defining a plurality of widths of one or more columns within the merchandising tray. In some embodiments, there are slots at regular intervals for engagement of the rails or protrusions from the rails. Typically, each display tester unit has a merchandising tray behind it, and both the display tester unit and the merchandising trays are located on a shelf. Additionally or alternatively, the rails may be adjustable with respect to their heights.

Figure 4:
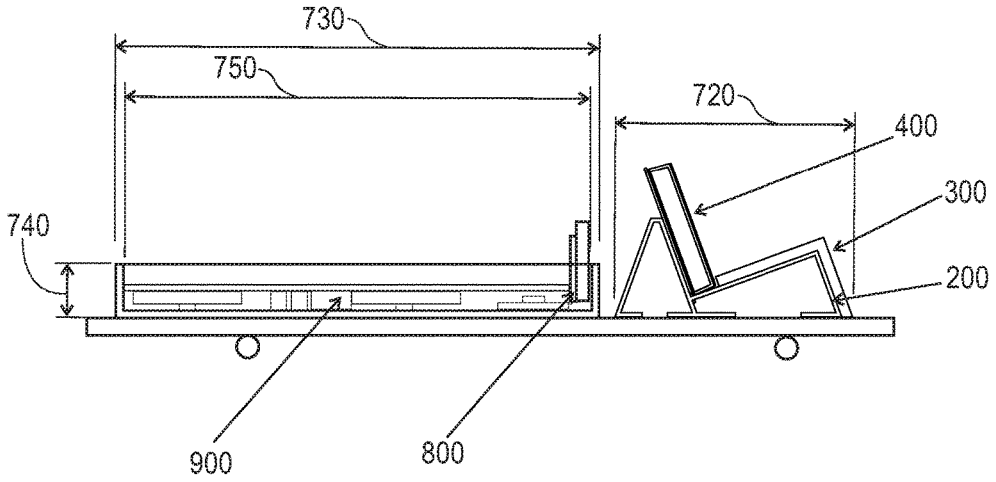
FIG. 4 is a representation of a tray with rails behind a display tester unit of the present invention on a shelf.

As shown in FIG. 4, in some embodiments, the cosmetic display system of the present invention further comprises a rail 900 and pusher 800 system, wherein the rail and pusher system comprises a tension coil. The rail and pusher system may be located within a tray such as a molded tray that sits in a merchandising tray and thus the molded tray would have a width 750 and length that are slightly smaller than the width 730 and length of the merchandising tray, but may have a depth that is the same or less than the height 740 of the merchandising tray. By use of the rail and pusher system, goods may be caused to be moved forward when a force is exerted against the rear most packages by the pusher, e.g., a flat panel that spans a portion of or the entire width of the tray. The pusher may, at its rear side, be attached to a tension coil that exerts a force toward the front of the tray, i.e., where the display tester unit comprising the base 200, the ledge 300 and the fluted panel 400 are located. In some embodiments, the display tester unit has a width 720 (front to back) that is smaller than that of the merchandising tray behind it. The trays may be partially or completely obscured by the display units. Additionally, depending on the size of the goods contained in the tray, those goods may or may not be visible when a person looks as the display unit.

Methods

The display tester units of the present invention may be assembled by placing the base on a shelf or other surface, preferably a flat surface. One then places the ledge on the base so that the second inner surface of the ledge contacts and rests on the front surface of the base, and the first inner surface of the ledge rests on and contacts the first surface of the receiving region.

One also may place the fluted panel on the base. The fluted panel is placed on the base so that part or all of its rear side contacts the second surface of the receiving region of the base. If there is a recess between the first surface of the receiving region and the second surface of the receiving region, and the fluted panel has a protruding element on a side, that protruding element may be inserted into the recess. The portion of the peaks and valleys that are closest to the first surface may partially cover it and depending on the size of the protruding element may or may not contact the first surface of the receiving region.

The display tester unit may be placed in front of, and optionally adjacent to and abutting a merchandising tray. One or more products that are the same as or are related to what is in the merchandising tray may be placed on the display tester unit as assembled such that each of those one or more products is located between a pair of peaks. Those products are testers, and consumers may remove them from the unit, try the contents, and return the container to the unit. Preferably, the user will see that the tester was a sample of and was located in front of merchandise that can be purchased. Additionally, if the sample was located in front of products for sale, the consumer will know to where to return the product.

If the merchandising tray is configured with a rail and pusher system, as consumers remove items from the tray and decrease its inventory, the pusher will move the remaining inventory forward.

Because the fluted panel is not attached permanently to the display tester unit, a store manager or other person in charge of maintaining a display can efficiently and cost-effectively change the types and sizes of products to meet consumer demand and product inventory. For example, a first fluted panel may form cavities of a first uniform size for displaying items. Once the items have been sold out, a person managing the display may remove the first fluted panel and insert a second fluted panel that forms cavities of second uniform size where the second uniform size is different from the first uniform size. She can then display and sell products of different sizes without changing the base. She also has the option but not the need to change the ledge when changing the fluted panel.

Alternatively or additionally, a given fluted panel may have a plurality of different sized cavities. When changing inventory, one can select a cavity of an applicable size, i.e., with a distance between consecutive peaks that is larger than the width of the item to be displayed, without removing the fluted panel. Additionally or alternatively, if the try has adjustable side rails, one can locate them so that the columns that they form are located behind cavities of a corresponding size.

As noted above, the various components of the present invention may comprise, consist essentially of, or consist of any of a number of materials. To form the components, one may, for example, use injection molding or three dimensional printing, or any other technique that is now known or that comes to be known and that a person of ordinary skill in the art would appreciate as being useful in connection with the present invention.

Any of the features of the various embodiments described herein can be used in conjunction with features described in connection with any other embodiments disclosed unless otherwise specified. Thus, features described in connection with the various or specific embodiments are not to be construed as not suitable in connection with other embodiments disclosed herein unless such exclusivity is explicitly stated or implicit from context.

The invention claimed is:

1. A product display tester unit comprising:

(a) a base comprising: a first front surface having a first bottom edge and a first top edge, the first front surface slopes upward from the first bottom edge to the first top edge; a first rear surface having a second top edge and a second bottom edge; and a receiving region located between the first front surface and the first rear surface, wherein the receiving region comprises a first surface and a second surface, wherein the first surface is generally planar and the first surface has a first width and a first rear edge, wherein the first surface of the receiving region slopes downward across the first width from the first top edge to the first rear edge, wherein the second surface of the receiving region has a third bottom edge and a third top edge, wherein the second surface of the receiving region slopes upward from the third bottom edge to the third top edge, wherein a recess is defined between the first rear edge of the first surface of the receiving region and the second surface of the receiving region;

wherein the first top edge of the first front surface is located at a first height above a plane defined by a bottom of the base, wherein the second top edge of the first rear surface is located at a second height above the plane defined by the bottom of the base, wherein the third top edge of the second surface is located at a third height above the plane defined by the bottom of the base, wherein an upper portion of the first rear edge of the first surface of the receiving region is located at a fourth height above the plane defined by the bottom of the base, and a bottom portion of the recess is located at a fifth height above the plane defined by the bottom of the base, wherein each of the second height and the third height is higher than the first height, and wherein the fifth height is below the fourth height;

(b) a ledge, wherein the ledge has a first ledge surface and a second ledge surface, wherein the first ledge surface has a first upper edge and a first lower edge, wherein the second ledge surface has a second width and a second rear edge, wherein the first ledge surface slopes upward from the first lower edge to the first upper edge and the second ledge surface slopes downward from the first upper edge to the second rear edge, wherein the second width is smaller than the first width; and (c) a fluted panel having a third width, a second front surface, a second rear surface, a top surface, and an engagement element at a bottom of the fluted panel, wherein the second front surface of the fluted panel defines a plurality of alternating peaks and valleys, wherein the peaks are protrusions each having a fourth width and at least a first thickness, wherein the fourth width is substantially equal to the third width, wherein each valley is a cavity formed between a corresponding pair of consecutive peaks from said plurality of peaks, wherein the engagement element has a second thickness, wherein the second thickness is less than the first thickness;

wherein the ledge is removably placed on top of the first front surface of the base and the first surface of the receiving region, wherein the fluted panel removably rests on and abuts the second surface of the receiving region with the engagement element being inserted within the recess and located between the first rear edge of the first surface of the receiving region and the second surface of the receiving region; wherein the valleys are configured to receive a plurality of cosmetic items therein.

2. The product display tester unit of claim 1, wherein the second height is the same as the third height.

3. The product display tester unit of claim 1 in combination with a first cosmetic item and a second cosmetic item from said plurality of cosmetic items, wherein the first cosmetic item has a first cosmetic width, wherein the second cosmetic item has a second cosmetic width, and wherein the first cosmetic width is different from the second cosmetic width.

4. The product display tester unit of claim 1, wherein the third width of the fluted panel is greater than a distance from the third bottom edge of the second surface of the receiving region to the third top edge of the second surface of the receiving region.

5. The product display tester unit of claim 1, wherein the first ledge surface of the ledge is configured to cover the entire first front surface of the base.

6. The product display tester unit of claim 1, wherein a distance between each pair of consecutive peaks from said plurality of peaks is between ⅛th of an inch and 3 inches.

7. The product display tester unit of claim 6, wherein the distance between each pair of consecutive peaks from said plurality of peaks is between ⅜th of an inch and 1½ inches.

8. The product display tester unit of claim 1, wherein each peak has a smooth surface.

9. The product display tester unit of claim 1, wherein each peak has a textured surface.

10. The product display tester unit of claim 1, wherein there is a uniform spacing between each pair of consecutive peaks from said plurality of peaks.

11. The product display tester unit of claim 1, wherein the first rear surface slopes downward from the second top edge to the second bottom edge.

12. The product display tester unit of claim 1, wherein the ledge is configured to contact the fluted panel.

13. The product display tester unit of claim 1, wherein the ledge is spaced from the fluted panel and the second rear edge of the ledge is 1/64th of an inch to 1 inch away from the fluted panel.

14. A product display system comprising:

(a) the product display tester unit of claim 1;

(b) a merchandising tray; and (c) a shelf wherein the product display tester unit and the merchandising tray are located on the shelf.

15. The product display system of claim 14, wherein the merchandising tray further comprises a pusher system.

* * * * *